US008720727B2

(12) United States Patent
Foldesi, Jr. et al.

(10) Patent No.: US 8,720,727 B2
(45) Date of Patent: May 13, 2014

(54) DUAL TAB LID

(75) Inventors: Steve Foldesi, Jr., Hinesburg, VT (US); Steve Foldesi, Hinesburg, VT (US)

(73) Assignee: Nestech Machine Systems, Inc., Hinesburg, VT (US)

( * ) Notice: Subject to any disclaimer, the term of this patent is extended or adjusted under 35 U.S.C. 154(b) by 1058 days.

(21) Appl. No.: 11/503,687

(22) Filed: Aug. 14, 2006

(65) Prior Publication Data

US 2008/0035641 A1 Feb. 14, 2008

(51) Int. Cl.
*B65D 17/40* (2006.01)

(52) U.S. Cl.
USPC ..... 220/276

(58) Field of Classification Search
USPC ..... 220/266, 270, 276; 215/254, 255, 256, 215/235
See application file for complete search history.

(56) References Cited

U.S. PATENT DOCUMENTS

| | | | | | |
|---|---|---|---|---|---|
| 3,347,407 | A | * | 10/1967 | Cooldige, Jr. et al. | 220/257.2 |
| 3,557,998 | A | * | 1/1971 | Collie | 220/270 |
| 3,572,579 | A | * | 3/1971 | Mueller et al. | 229/123.2 |
| 3,707,240 | A | * | 12/1972 | Wilson | 215/256 |
| 3,753,512 | A | * | 8/1973 | Curry | 220/260 |
| 4,103,803 | A | * | 8/1978 | Irvine | 220/270 |
| 4,315,791 | A | | 2/1982 | Ishii et al. | |
| 4,531,650 | A | * | 7/1985 | Friendship | 215/256 |
| 4,702,389 | A | * | 10/1987 | Bozinovich et al. | 220/784 |
| 5,052,574 | A | * | 10/1991 | McKinnon et al. | 220/276 |
| 6,499,621 | B1 | | 12/2002 | Yamaguchi et al. | |
| 2005/0133508 | A1 | | 6/2005 | Landis et al. | |
| 2005/0189353 | A1 | * | 9/2005 | Padovani | 220/276 |
| 2005/0269328 | A1 | * | 12/2005 | Crider et al. | 220/276 |
| 2006/0006178 | A1 | | 1/2006 | Foldesi, Sr. et al. | |

FOREIGN PATENT DOCUMENTS

| | | | |
|---|---|---|---|
| BR | MU8502287-0 | U | 6/2007 |
| GB | 2236099 | A1 | 3/1991 |
| WO | WO2004043800 | A2 | 5/2004 |
| WO | WO2005056414 | A1 | 6/2005 |

OTHER PUBLICATIONS

Examiner's annotated Figure 2 of US Pat. No. 3,707,240.*
International Search Report of PCT/US07/17832.

* cited by examiner

*Primary Examiner* — Anthony Stashick
*Assistant Examiner* — James N Smalley
(74) *Attorney, Agent, or Firm* — James Marc Leas

(57) ABSTRACT

A packaging system includes a lid having a permanent portion and a removable portion. The permanent portion includes a first tab. The removable portion includes a second tab. In one embodiment a partially cut line extends between the permanent portion and the removable portion. In one embodiment the removable portion includes a latching region for latching to a container. In one embodiment the first tab is coplanar with the second tab. In one embodiment the lid includes a planar region and the second tab is coplanar with the planar region.

45 Claims, 10 Drawing Sheets

DUAL TAB LID

RELATED APPLICATIONS

This patent application is related to commonly assigned U.S. Patent Application 2006/0006178 "Tamper-Indicating Food Container Lid," with application Ser. No. 11/167,995, filed Jun. 29, 2005, incorporated herein by reference.

FIELD

This patent application generally relates to a lid for a container. More particularly, it relates to a system for securing a lid to a container for restricting or detecting tampering while providing easy access by the consumer.

BACKGROUND

Systems have been used, such as shrink wrap, to restrict access to a container as well as to make identifiable any such unwanted access to the container before purchase. Shrink wrapping has required a separate shrink wrap material to be applied in the area of the rim of the lid and extending down over the container, adding to expense for packaging. Shrink wrap has also been difficult for the consumer to remove, often impelling the consumer to resort to using a knife, which is inconvenient and could be somewhat dangerous to the consumer.

A system described in commonly assigned U.S. patent application Ser. No. 11/167,995 and publication No. 2006/0006178, "Tamper-Indicating Food Container Lid," avoids these problems by providing an outer rim member that engages the rim of the container to prevent tampering. This outer rim member includes laser slitting, allowing the outer rim member to be removed by the consumer. The outer rim member also includes a tab for the consumer to hold onto while removing the outer rim. The tab is formed in the laser slitting process.

However, further improvement has been desired so the consumer can even more easily take advantage of the slitting to remove the removeable portion, and this solution is provided by the following invention.

SUMMARY

A packaging system includes a lid having a permanent portion and a removable portion. The permanent portion includes a first tab and the removable portion includes a second tab.

In one aspect a packaging system comprises a lid including a rim having a first tab and a second tab. The first tab is coplanar with the second tab.

In one aspect a packaging system comprises a lid including a planar region and a rim region. The rim region has a removable portion including a tab that extends in a plane that is substantially parallel to the planar region.

One aspect is a method of fabricating a packaging. The method includes providing a container and providing a lid. The lid includes a permanent portion and a removable portion. The permanent portion includes a first tab and the removable portion includes a second tab. The method includes pressing this lid onto the container.

DETAILED DESCRIPTION

Figure 1A:
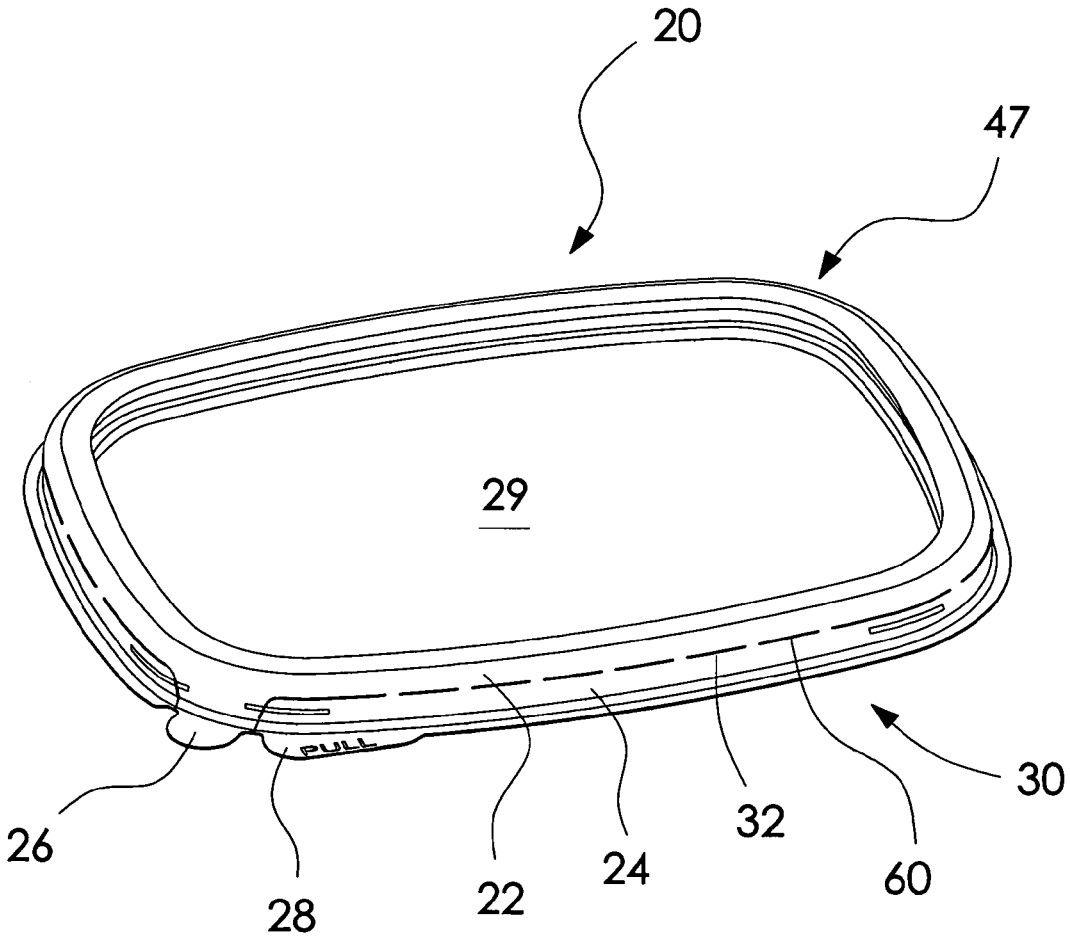
FIG. 1*a* is a three dimensional view of the lid of the present patent application with its removable portion in place and showing two coplanar tabs.
Figure 1B:
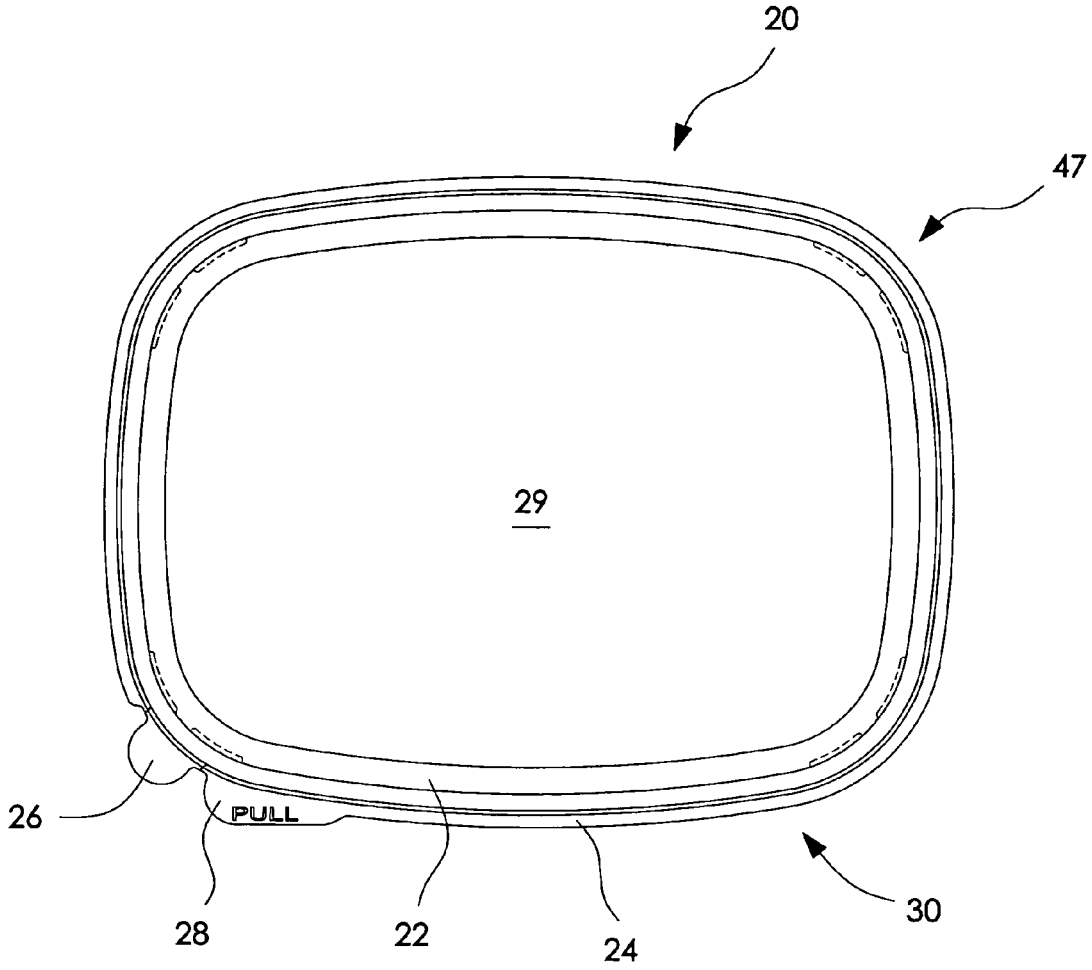
FIG. 1*b* is a top view of the lid of FIG. 1*a;*

One aspect of the present patent application is a packaging system that includes lid 20 having permanent portion 22 and removable portion 24, as shown in FIGS. 1*a*-1*b* and FIGS. 2*a*-2*b*. Permanent portion 22 includes first tab 26 and removable portion 24 includes second tab 28. These tabs 26, 28 may be adjacent each other. Both tabs 26, 28 extend outwardly from lid rim 30 so the consumer can easily find and grasp tab 26 in the left hand and tab 28 in the right hand. Tab 26 and tab 28 may extend in the same plane. Tab 26 and tab 28 can be in the same plane as planar portion 29 of lid 20. The consumer can hold first tab 26 on permanent portion 22 while pulling on second tab 28 on removable portion 24 to completely remove that removable portion 24. Partially cut line 32 makes removal easy. Second tab 28 may include a label directing a user to "pull" the second tab.

Figure 3A:
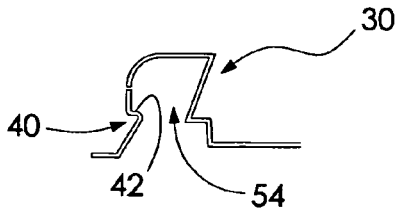
FIG. 3*a* is a cross sectional view of the lid of FIG. 1*a* showing a latching region.
Figure 4A:
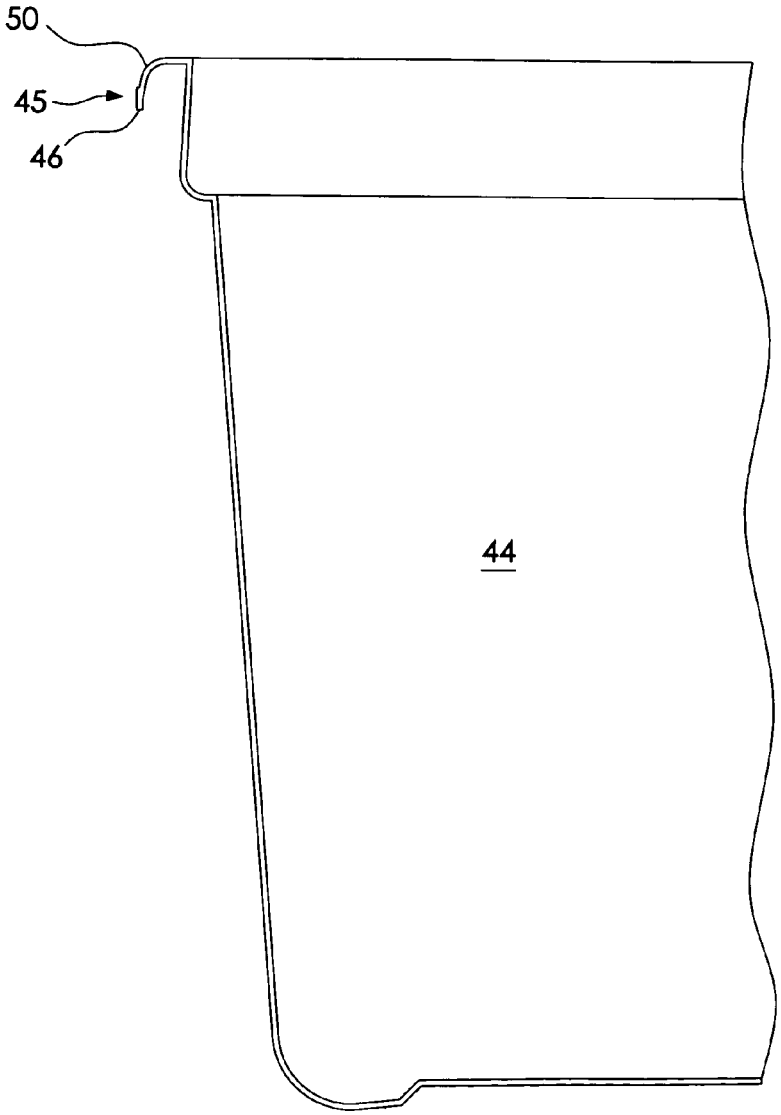
FIG. 4*a* is a cross sectional view of a container for mating with the lid of FIG. 1*a;*

Removable portion 24 can include latching region 40 with indentation 42 extending inward toward container 44. Latching region 40 holds lid 20 firmly on container 44 while removable portion 24 is in place on lid 20, as shown in FIG. 3*a*. Removal of lid 20 from container 44 is restricted as long as removable portion 24 remains substantially in place. Container latch receiving region 45 may simply include edge 46 of container 44, as shown in FIGS. 4*a*-4*b*.

Figure 4B:
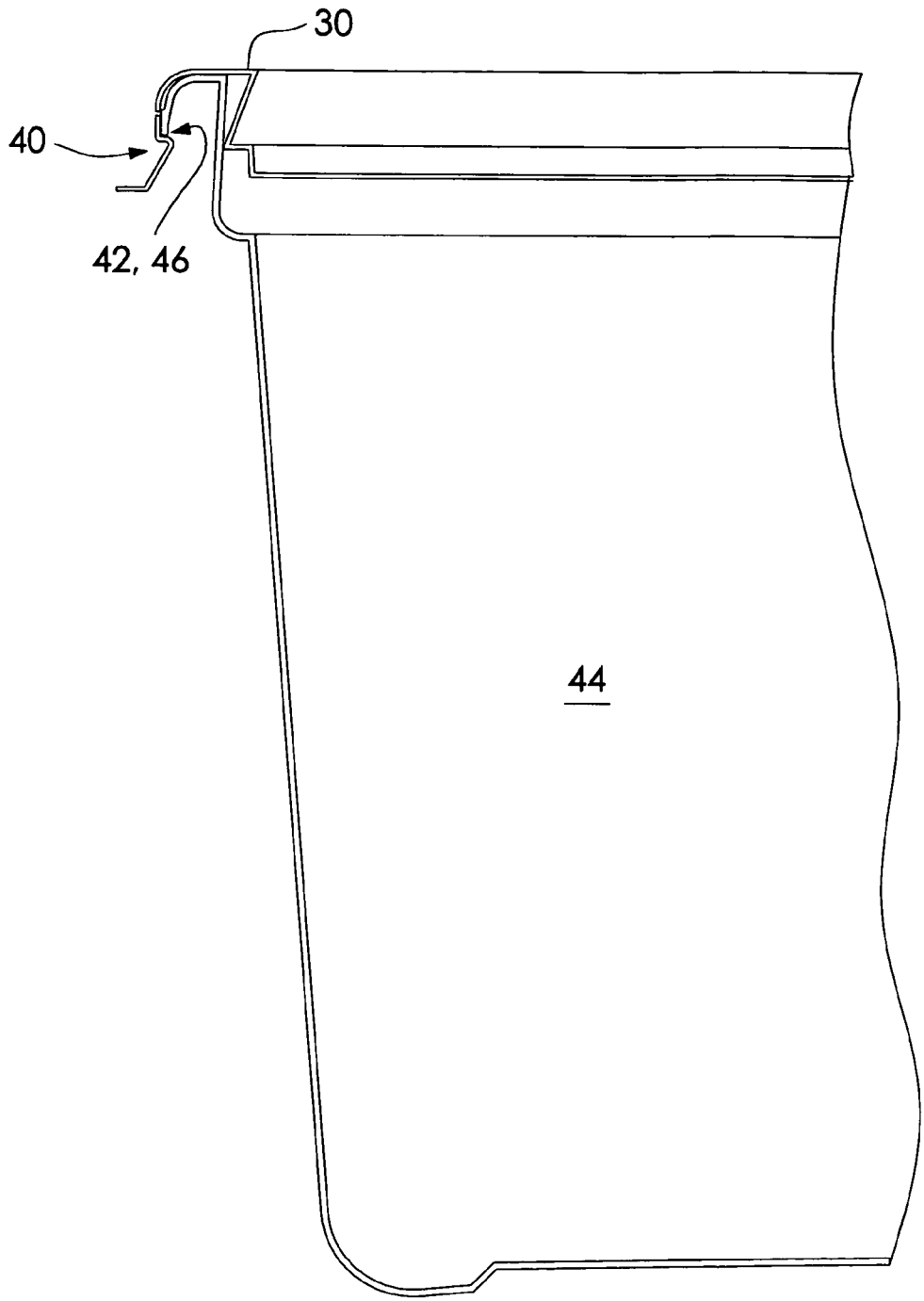
FIG. 4*b* is a cross sectional view of the container of FIG. 4*a* mating with the lid of FIG. 1*a* and showing the latching of indented portions of the lid with an edge of the container.

Since lid latching region 40 with its indentation 42 is substantially located on removable portion 24, removal of removable portion 24 by the consumer removes this latching region 40 and thus allows easy removal of lid 20 from container 44, shown in FIG. 4*b*. Several such latching regions 40 can be provided spaced around lid rim 30. For example, one latching region 40 can be provided on each side at each corner 47 of lid 20, as shown in FIGS. 1*a*-1*b*, 2*a*-2*b*, providing a total of eight latching regions 40. While indentations 42 can be provided all around removable portion 24, the present applicants found that spaced latching regions 40 provided adequate restraint from improper removal of lid 20. On rectangular lids latching regions may be on each side of each corner 47. On round lids latching regions may be uniformly spaced around removable portion 24.

Figure 3B:
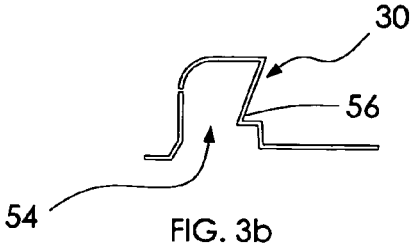
FIG. 3*b* is a cross sectional view of the lid of FIG. 3*a* showing a part between such latching regions.
Figure 5A:
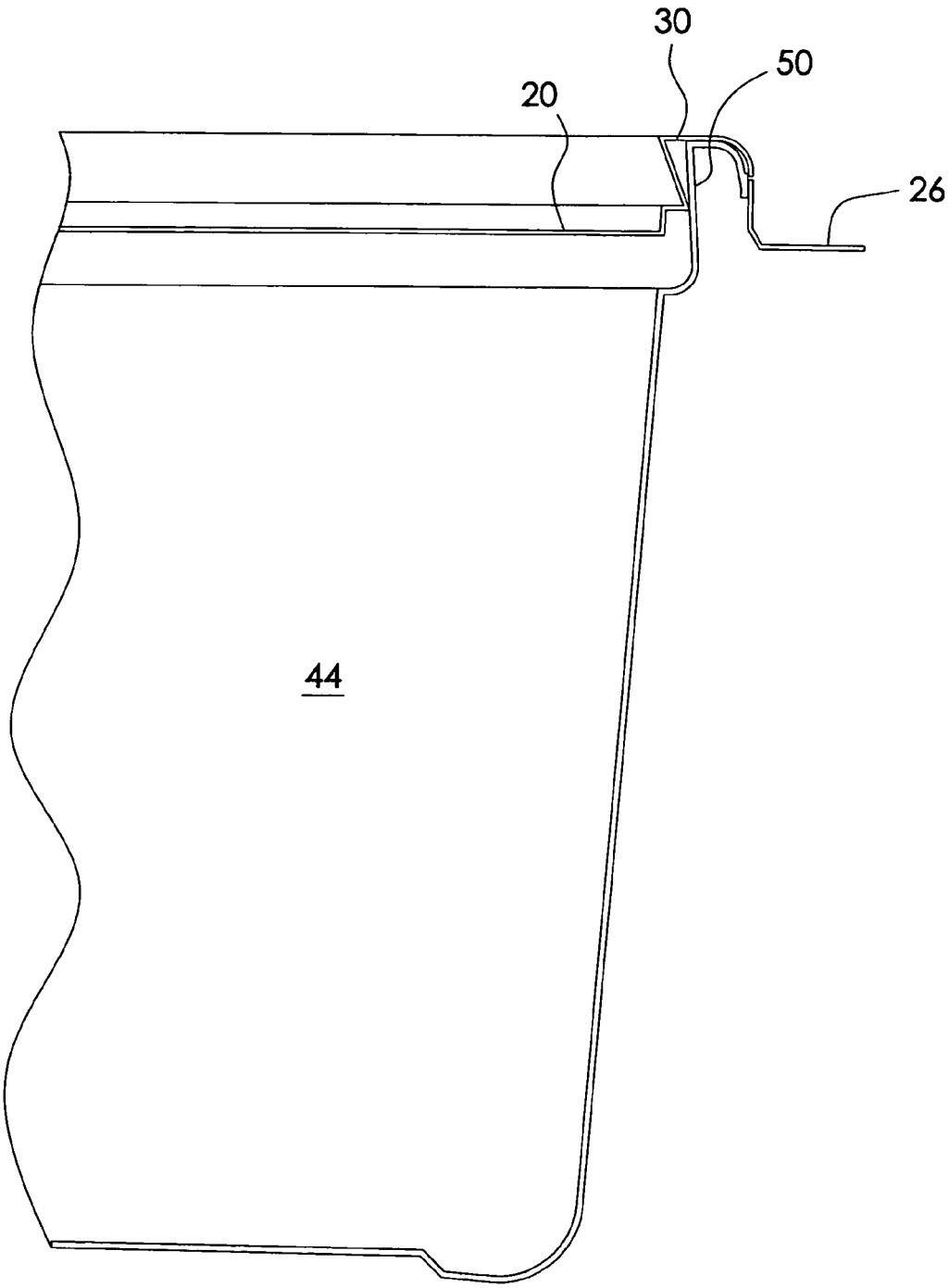
FIG. 5*a* is a cross sectional view of the container of FIG. 4*a* mating with the lid of FIG. 1*a* through the first tab of the lid, showing the first tab of the lid extending in the same plane as the planar region of the lid.

In space between latching regions 40 indentation 42 is not provided, as shown in FIG. 3*b* and in FIG. 5*a*.

Figure 2A:
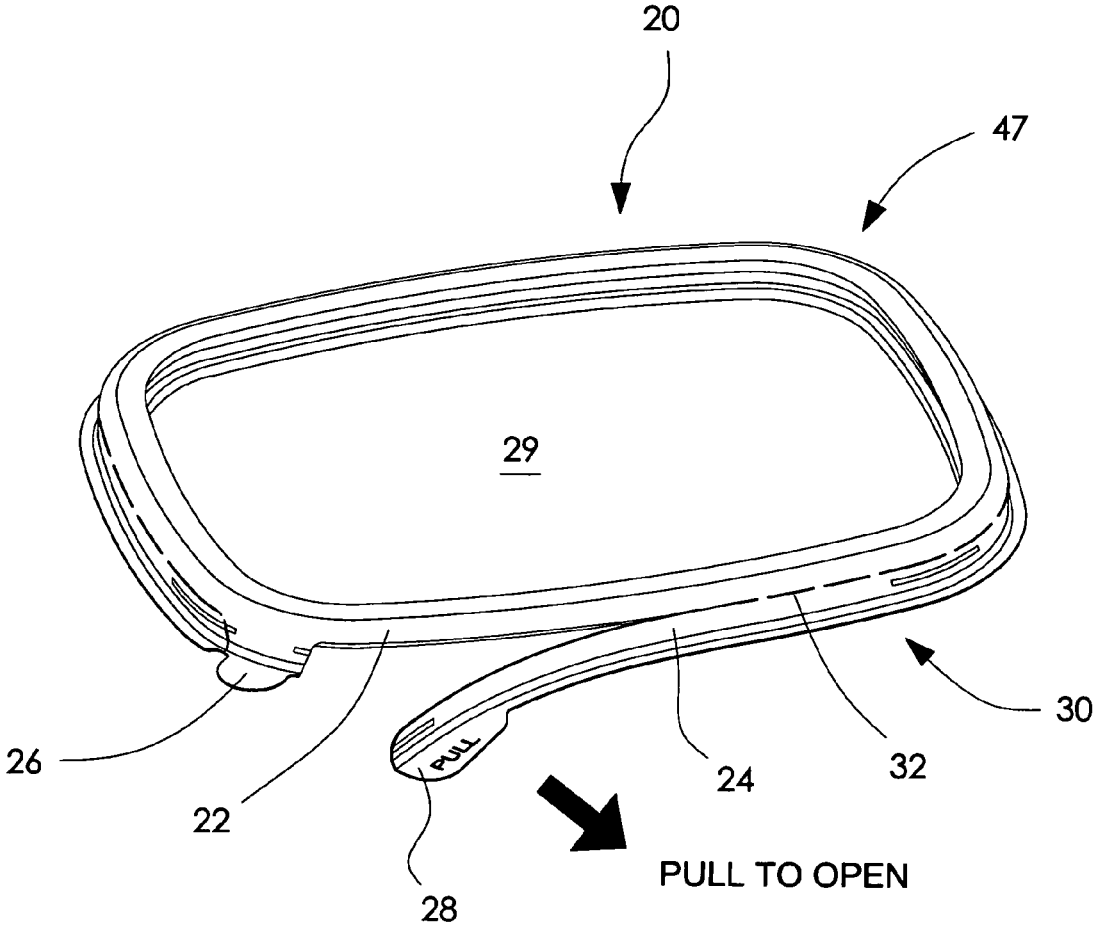
FIG. 2*a* is a three dimensional view of the lid of FIG. 1*a* after the tab on the removeable portion has been pulled to remove part of the removable portion.
Figure 2B:
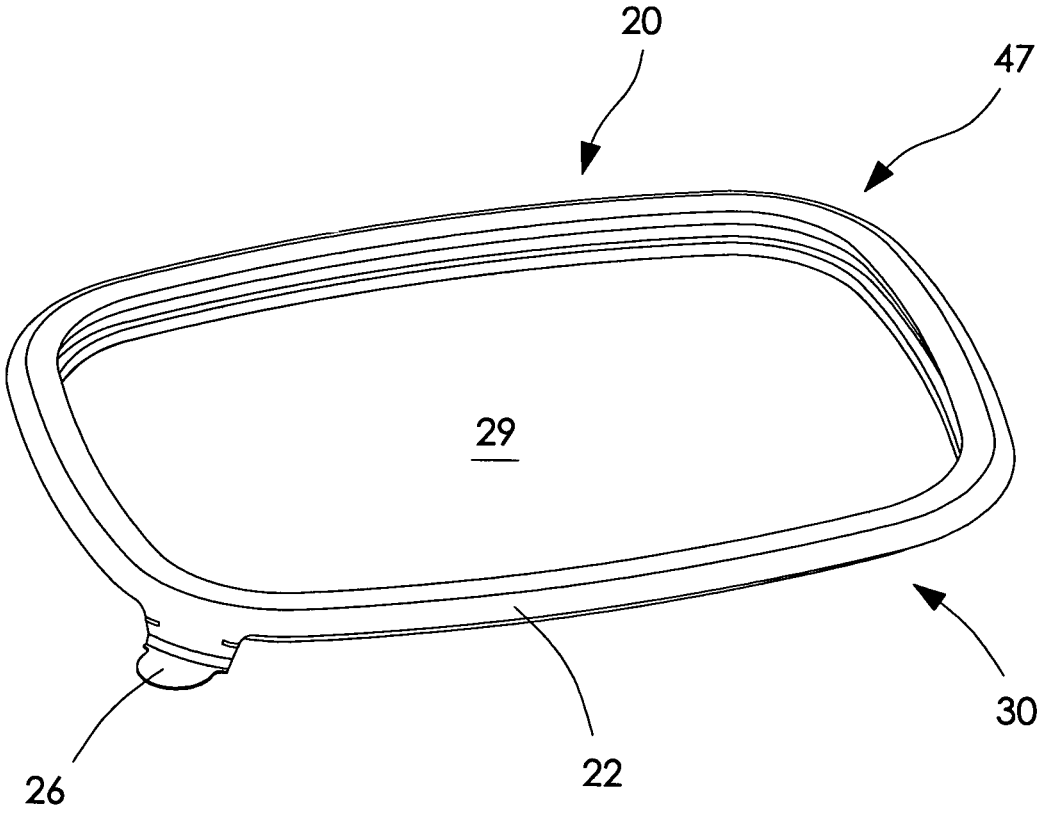
FIG. 2*b* is a three dimensional view of the lid of FIG. 2*a* after the tab on the removeable portion has been pulled to remove the entire removable portion.
Figure 5B:
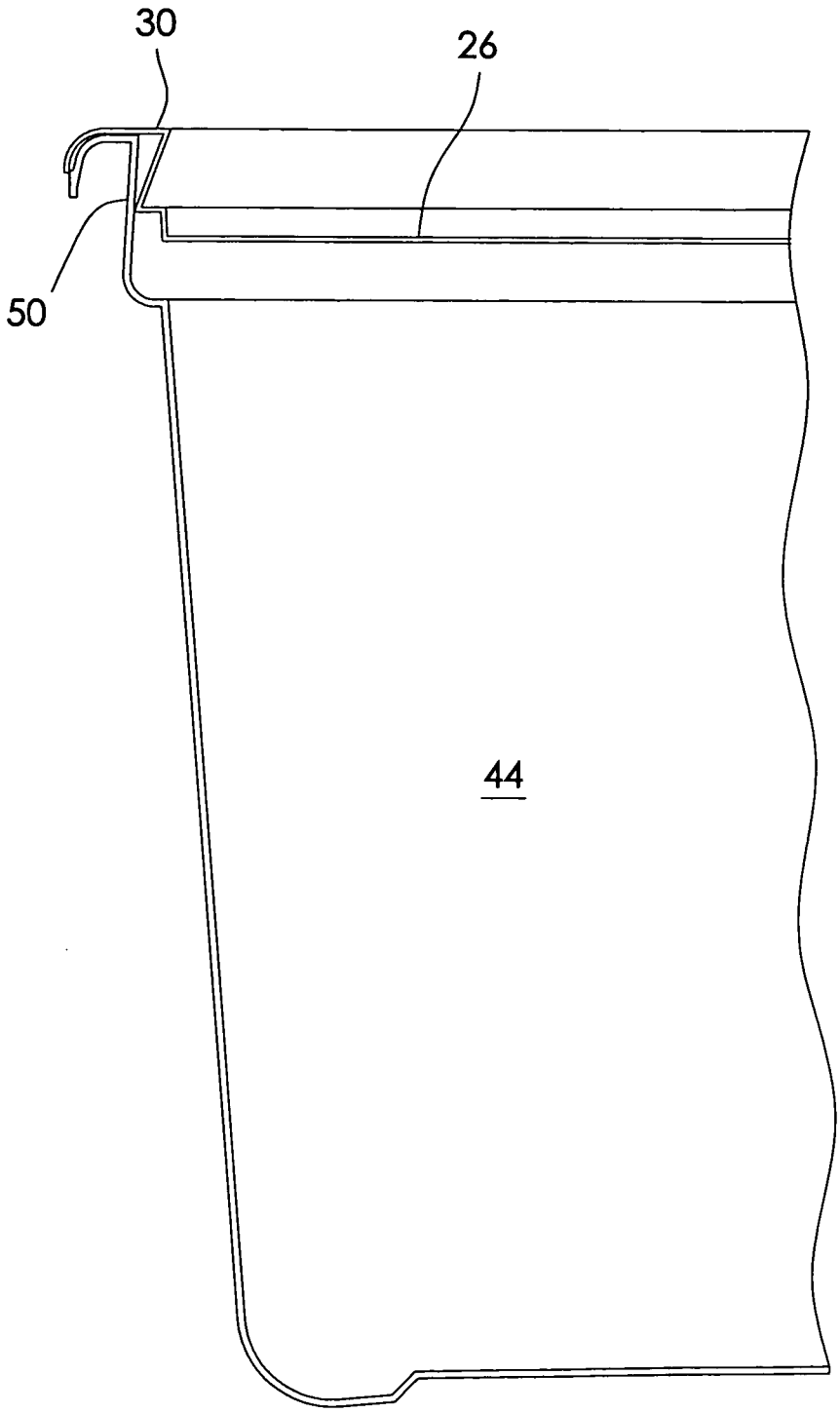
FIG. 5*b* is a cross sectional view of the container of FIG. 5*a* mating with the lid of FIG. 1*a* after removal of the removable portion and outside of the region of the first tab of the lid.

First tab 26 still remains in place on lid 20 after removable portion 24 has been removed, facilitating lid removal from container 44 and lid replacement on container 44, as shown in FIG. 2*b* and in FIG. 5*a*. In this region and in other regions around lid rim 30, a pressure fit holds container rim 50 to lid rim 30, as shown in FIGS. 5*a*, 5*b*. This pressure fit results from sizing of container rim 50 slightly larger than interior space 54 of lid rim 30, as shown in FIGS. 3*a*-3*b*, as well as from the shape provided to sidewalls 56 of lid rim 30. Also, permanent portion 22 has a larger radial extent than container rim 50 all around container rim 50. Thus, lid 20 initially has two mechanisms holding it to container 44, the pressure fit and the latching. Once removable portion 24 has been removed, lid 20 is held to container 44 with only the pressure mechanism.

Partially cut line 32 is located between permanent portion 22 and removable portion 24. Partially cut line 32 may include a plurality of holes 60. Holes 60 may be approximately equally spaced around lid rim 30. Holes 60 may be formed by laser cutting using a laser, such as the F201 $CO_2$ laser from Synrad, Inc., Mukilteo, Wash. The holes can also be formed by mechanically punching. They may also be formed with a cutting knife. The holes may be slit shaped as shown in FIG. 1*a*. Long slots are separated by short bridges in one embodiment, as shown in FIG. 2*a*. The long slots are at least twice the length of the spaces there between. The first tab can include such slit shaped holes extending on both of its sides, as shown in FIG. 1*a*. In one embodiment the slot length was more than five times the spacing. Alternatively, a laser can also be used to scribe a continuous line, removing sufficient material to weaken the material.

Fabricating the package includes providing a container and providing a lid that includes a permanent portion and a removable portion, the permanent portion including a first tab and the removable portion including a second tab. The process further includes pressing the lid onto the container.

The removable portion can include a lid latching region and the container can include a container latching region, wherein the lid latching region is for latching the removable portion to the container latching region. The process of pressing the lid onto the container can include latching the lid latching region to the container latching region. Removal of the lid from the container is restricted as long as the removable portion, with its lid latching region, remains substantially in place.

Container 44 and its mating lid 20 can have any shape, such as square, rectangular, circular, or oval. Lid 20 can be fabricated using a process such as thermoforming or injection molding.

In using the package the consumer may pull on the second tab to remove the removable portion.

Figure 6A:
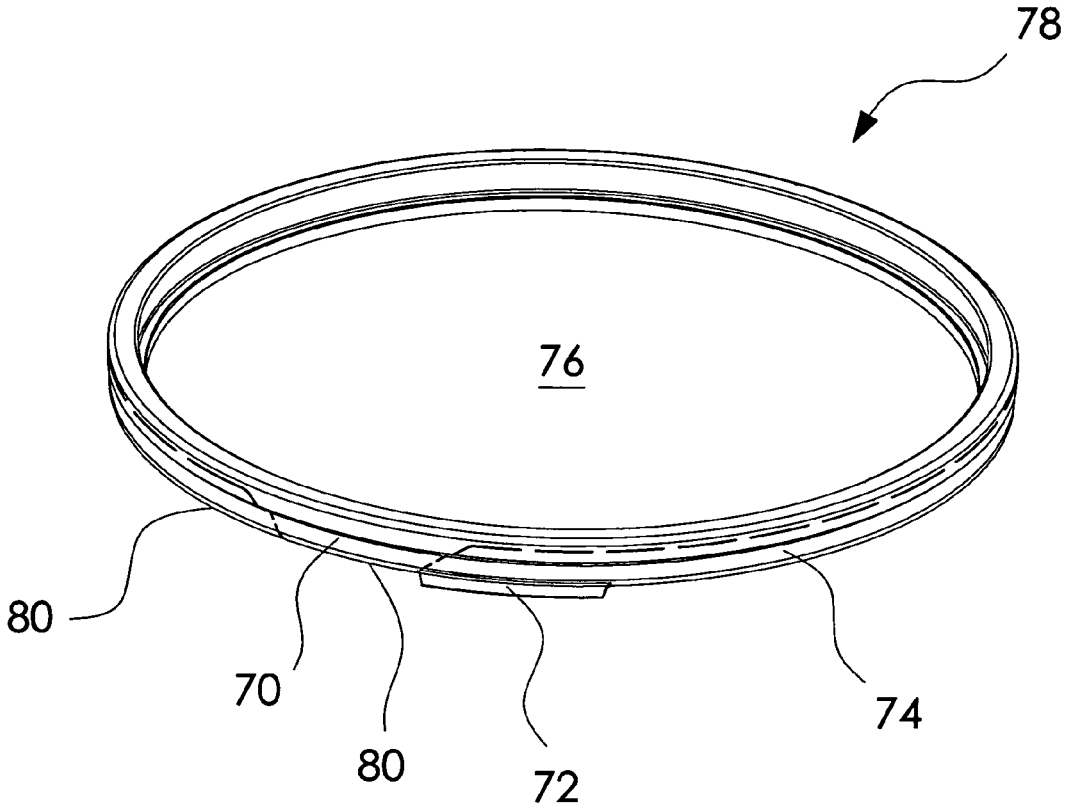
FIG. 6*a* is a three dimensional view of another embodiment of the lid of the present patent application with its removable portion in place and showing two different tabs.
Figure 6B:
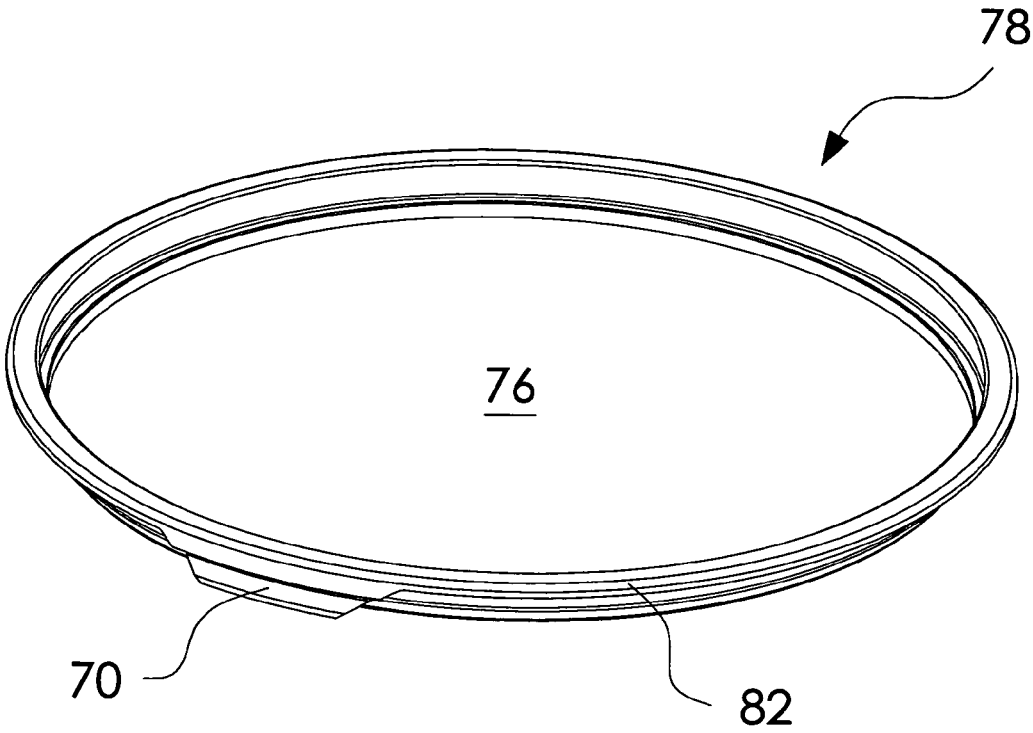
FIG. 6*b* is a three dimensional view of the lid of FIG. 6*a* after the tab on the removeable portion has been pulled to remove the removable portion.

Another embodiment with two differently shaped tabs 70, 72, as shown in FIG. 6*a*, 6*b*. Tab 72 extends from removable portion 74 in a plane parallel to planar region 76 of round lid 78. Tab 70 has bottom edge 80 following the contour of bottom edge 80' of removable portion 74. When tab 72 is pulled by the consumer to remove removable portion 74, remaining tab 70 is left extending down lower than other portions of rim 82 of round lid 78, as shown in FIG. 6*b*. In this embodiment the consumer may hold the container while pulling on removable tab 72 to entirely remove removable tab 72. The consumer will find that tab 70 can then be used to pull off lid 78.

While several embodiments, together with modifications thereof, have been described in detail herein and illustrated in the accompanying drawings, it will be evident that various further modifications are possible without departing from the scope of the invention as defined in the appended claims. Nothing in the above specification is intended to limit the invention more narrowly than the appended claims. The examples given are intended only to be illustrative rather than exclusive.

What is claimed is:

1. A packaging system, comprising a container and an openable lid, wherein said container includes a container rim, wherein said openable lid is mounted to said container rim, wherein said openable lid includes a central region, a lid rim, a first tab, a second tab, and a partially cut line, wherein said lid rim surrounds said central region, wherein said lid rim has a lid rim inner wall and a lid rim outer wall, wherein said lid rim inner wall is for positioning inside said container rim and wherein said lid rim outer wall is for positioning outside said container rim, wherein said partially cut line includes a plurality of holes, wherein said partially cut line is located on said lid rim outer wall, wherein said partially cut line defines a permanent portion of said lid rim outer wall and a removable portion of said lid rim outer wall, wherein said permanent portion extends all around said lid rim, wherein said first tab and said second tab are located outside said lid rim outer wall, wherein said first tab is connected to said permanent portion, said inner wall, and said central planar region, wherein said second tab is connected to said removable portion, wherein said lid remains held to said container rim by a pressure applied to said container rim by said permanent portion and by said lid rim inner wall when said second tab and said removable portion are removed, wherein said permanent portion has a larger radial extent than said container rim all around said container rim, wherein said container rim is larger than interior space between said permanent portion and said lid rim inner wall to apply said pressure all around said container rim when said second tab and said removable portion are removed.

2. A packaging system as recited in claim 1, wherein said first tab and said second tab extend in the same plane before removal of said second tab.

3. A packaging system as recited in claim 1, wherein said first tab is adjacent said second tab before removal of said second tab.

4. A packaging system as recited in claim 1, wherein said plurality of holes are spaced about equally around said lid.

5. A packaging system as recited in claim 1, wherein said plurality of holes are laser formed holes.

6. A packaging system as recited in claim 1, wherein said plurality of holes are slit shaped.

7. A packaging system as recited in claim 6, wherein said plurality of slit shaped holes have a length, wherein said slit shaped holes are separated by a space, wherein said length is at least two times said space.

8. A packaging system as recited in claim 1, wherein said first tab includes a first side and a second side, wherein a plurality of said holes extends on said first side and wherein a plurality of said holes extends on said second side.

9. A packaging system as recited in claim 1, wherein said second tab includes a label directing a user to pull said second tab.

10. A packaging system as recited in claim 1, wherein said removable portion of said rim lid outer wall includes a lid latching region and wherein said container includes a container latching region, wherein said lid latching region is for latching said removable portion of said rim lid outer wall to said container latching region, wherein removal of said lid from said container is restricted as long as said removable portion of said rim lid outer wall remains substantially connected to said permanent portion of said rim lid outer wall.

11. A packaging system as recited in claim 10, wherein said lid latching region includes a latch portion extending inward toward said container and wherein said container includes a latch receiving region for receiving said latch.

12. A packaging system as recited in claim 11, wherein said container latch receiving region includes an edge of said container.

13. A packaging system as recited in claim 10, wherein said removable portion of said rim lid outer wall includes a plurality of said lid latching regions.

14. A packaging system as recited in claim 10, wherein said lid latching region is substantially located on said removable portion of said rim lid outer wall.

15. A packaging system as recited in claim 1, wherein said lid is more easily removed from said container when said removable portion of said rim lid outer wall has been removed.

16. A packaging system as recited in claim 1, wherein said container rim and said lid rim are shaped to fit together to provide said pressure for holding said lid to said container when said removable portion of said rim lid outer wall has been removed.

17. A packaging system as recited in claim 1, wherein said partially cut line extends between said first tab and said second tab.

18. A packaging system, comprising a container and an openable lid, wherein said container includes a container rim, wherein said openable lid is mounted to said container rim, wherein said openable lid includes a central planar region and a lid rim, wherein said lid rim has a lid rim inner wall, a lid rim outer wall, and a first tab, wherein said lid rim inner wall is for positioning inside said container rim and wherein said lid rim outer wall is for positioning outside said container rim, wherein said first tab extends in a plane parallel to said central planar region and wherein said first tab extends outside said lid rim outer wall, wherein a partially cut region is located on said lid rim outer wall, wherein said partially cut region extends around most of said lid rim outer wall, wherein said partially cut region defines a permanent portion of said lid rim outer wall and a removable portion of said lid rim outer wall, wherein said partially cut region includes a plurality of holes, wherein said first tab is connected to said removable portion, wherein said partially cut region extends adjacent said first tab, wherein a pressure is applied to said container rim by said permanent portion and by said lid rim inner wall when said first tab and said removable portion are removed, wherein said permanent portion has a larger radial extent than said container rim all around said container rim, wherein said container rim is larger than interior space between said permanent portion and said lid rim inner wall to apply said pressure all around said container rim, wherein said pressure holds said lid to said container when said first tab and said removable portion are removed.

19. A packaging system as recited in claim 18, further comprising a second tab, wherein said partially cut region extends between said first tab and said second tab.

20. A packaging system, comprising a lid and a container, wherein said container includes a container rim, wherein said lid is mounted to said container rim, wherein said lid includes a planar region, a rim region, and a partially cut line, wherein said rim region includes a tab, a lid rim inner wall, and a lid rim outer wall, wherein said lid rim inner wall is for positioning inside said container rim and wherein said lid rim outer wall is for positioning outside said container rim, wherein said lid rim outer wall has a permanent portion and a removable portion, wherein said partially cut line includes a plurality of holes, wherein said partially cut line is located on said lid rim outer wall, wherein said partially cut line defines said permanent portion and said removable portion, wherein said tab extends outside said lid rim outer wall and is connected to said removable portion, wherein said lid is held to said container rim by a pressure provided to said container rim by said permanent portion and by said lid rim inner wall when said tab and said removable portion are removed, wherein said permanent portion has a larger radial extent than said container rim all around said container rim, wherein said container rim is larger than interior space between said permanent portion and said lid rim inner wall to apply said pressure all around said container rim when said tab and said removable portion are removed.

21. A method of fabricating a packaging, comprising:

a. providing a container wherein said container includes a container rim;

b. providing an openable lid including a central region, a lid rim, and a tab, wherein said lid rim surrounds said central region, wherein said lid rim has a lid rim inner wall and a lid rim outer wall, wherein said lid rim inner wall is for positioning inside said container rim and wherein said lid rim outer wall is for positioning outside said container rim, wherein said tab extends outside said lid rim outer wall;

c. partially cutting a line on said lid rim outer wall, wherein said partially cutting a line includes at least one laser action from the group consisting of laser scribing, laser cutting, and laser slitting, wherein said partially cut line defines a permanent portion of said lid rim outer wall and a removable portion of said lid rim outer wall, wherein said removable portion has a connection to said container rim, wherein said removable portion is connected to said tab; and d. pressing said lid onto said container, wherein said lid is held to said container rim by said connection and by a pressure applied to said container rim by said permanent portion and by said lid rim inner wall, wherein said lid continues to be held to said container rim by said pressure when said tab and said removable portion are removed, wherein said container rim is larger than interior space between said permanent portion and said lid rim inner wall to apply said pressure all around said container rim when said tab and said removable portion are removed, wherein said permanent portion has a larger radial extent than said container rim all around said container rim.

22. A method as recited in claim 21, wherein said removable portion connection to said container rim includes a lid latching region and wherein said container includes a container latching region, wherein said lid latching region is for latching said removable portion to said container latching region, wherein removal of said lid from said container is restricted as long as said removable portion remains substantially connected to said permanent portion of said lid.

23. A method as recited in claim 21, further comprising pulling on said tab to remove said removable portion.

24. A packaging system as recited in claim 1, wherein said lid rim inner wall and said lid rim outer wall extend approximately perpendicular to said central planar region.

25. A packaging system as recited in claim 18, wherein said lid rim inner wall and said lid rim outer wall extend approximately perpendicular to said central planar region.

26. A packaging system as recited in claim 18, further comprising a second tab, wherein said first tab is coplanar with said second tab.

27. A packaging system as recited in claim 26, wherein said partially cut region extends between said first tab and said second tab.

28. A packaging system as recited in claim 18, wherein said plurality of holes are spaced about equally around said lid rim outer wall.

29. A packaging system as recited in claim 18, wherein said plurality of holes are laser formed holes.

30. A packaging system as recited in claim 18, wherein said plurality of holes are slit shaped.

31. A packaging system as recited in claim 30, wherein said partially cut line includes bridges between said slit-shaped holes.

32. A packaging system as recited in claim 30, wherein said plurality of slit-shaped holes have a length, wherein said slit-shaped holes are separated by a space, wherein said length is at least two times said space.

33. A packaging system as recited in claim 18, wherein said container has a container rim wherein said container rim and said lid rim are shaped to fit together to provide a pressure fit for holding said lid to said container.

34. A method as recited in claim 21, further comprising a second tab wherein said tab and said second tab extend outside said lid rim outer wall about an equal distance for grasping.

35. A packaging system as recited in claim 18, wherein said partially cut line extends parallel to said central planar region.

36. A packaging system as recited in claim 1, wherein said container includes a container sidewall having a lower portion and an upper portion, wherein said lower portion extends in a radial direction and has a lower portion maximum radial dimension, wherein said lower portion maximum radial dimension is less than said upper portion maximum radial dimension, wherein said lid rim inner wall extends to a lid rim inner wall radial dimension larger than said lower portion maximum radial dimension.

37. A packaging system as recited in claim 1, wherein said lid rim inner wall includes a shape for providing exclusively a ring of contact between said lid rim inner wall and said container rim to provide said pressure.

38. A method of fabricating a lid for a container that has a container rim, comprising:

a. providing an openable lid including a central region, and a lid rim, wherein said lid rim surrounds said central region, wherein said lid rim has a lid rim inner wall and a lid rim outer wall, wherein said lid rim inner wall is for positioning inside the container rim and wherein said lid rim outer wall is for positioning outside said container rim; and b. partially cutting a line in said lid rim outer wall, wherein said partially cutting a line includes at least one laser action from the group consisting of laser scribing, laser cutting, and laser slitting, wherein said partially cut line defines a permanent portion of said lid rim outer wall and a removable portion of said lid rim outer wall, wherein all portions of said lid rim outer wall below said partially cut line are removed when said removable portion is removed.

39. A method as recited in claim 38, wherein said partially cutting a line provides a tab for removing said removable portion.

40. A method as recited in claim 38, wherein said partially cutting a line provides a first tab and a second tab, wherein said permanent portion includes said first tab and wherein said removable portion includes said second tab.

41. A method as recited in claim 38, further comprising said container, wherein said lid rim inner wall and said lid rim outer wall provide a pressure fit to said container rim.

42. A method as recited in claim 1, wherein all portions of said lid rim outer wall below said partially cut line are removed when said removable portion is removed.

43. A method as recited in claim 18, wherein all portions of said lid rim outer wall below said partially cut region are removed when said removable portion is removed.

44. A method as recited in claim 20, wherein all portions of said lid rim outer wall below said partially cut line are removed when said removable portion is removed.

45. A method as recited in claim 21, wherein all portions of said lid rim outer wall below said partially cut line are removed when said removable portion is removed.

* * * * *